US008320781B2

(12) United States Patent
Muto

(10) Patent No.: US 8,320,781 B2
(45) Date of Patent: Nov. 27, 2012

(54) IMAGE PROCESSING APPARATUS AND IMAGE PROCESSING APPARATUS CONTROL METHOD

(75) Inventor: Hiroyuki Muto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 474 days.

(21) Appl. No.: 12/629,222

(22) Filed: Dec. 2, 2009

(65) Prior Publication Data

US 2010/0166443 A1 Jul. 1, 2010

(30) Foreign Application Priority Data

Dec. 25, 2008 (JP) ..... 2008-330896

(51) Int. Cl.
*G03G 15/00* (2006.01)
*G03G 15/08* (2006.01)

(52) U.S. Cl. ..... 399/49; 399/72

(58) Field of Classification Search ..... 399/49, 399/72; 356/221, 222, 445, 446, 448; 250/559.16, 250/559.4, 559.44
See application file for complete search history.

(56) References Cited

U.S. PATENT DOCUMENTS

| | | | | |
|---|---|---|---|---|
| 6,983,111 | B2 | 1/2006 | Ichikawa et al. | |
| 7,899,341 | B2 * | 3/2011 | Moro | 399/49 X |
| 2002/0110381 | A1 * | 8/2002 | Maebashi et al. | 399/49 |
| 2004/0208661 | A1 * | 10/2004 | Kitagawa et al. | 399/49 |
| 2004/0208662 | A1 | 10/2004 | Ichikawa et al. | |
| 2005/0135822 | A1 * | 6/2005 | Nakagawa | 399/49 |
| 2008/0253781 | A1 * | 10/2008 | Takezawa | 399/39 |

FOREIGN PATENT DOCUMENTS

| | | | |
|---|---|---|---|
| JP | 62-280869 | A | 12/1987 |
| JP | 3-209281 | A | 9/1991 |
| JP | 8-327331 | A | 12/1996 |
| JP | 2004-109321 | A | 4/2004 |
| JP | 2005-242349 | A | 9/2005 |
| JP | 2006-154024 | A | 6/2006 |
| JP | 2006-178373 | A | 7/2006 |
| JP | 2006-267591 | A | 10/2006 |
| JP | 2008-107399 | A | 5/2008 |
| JP | 2008-145595 | A | 6/2008 |
| JP | 2008-233369 | A | 10/2008 |

OTHER PUBLICATIONS

Notification of Reasons for Refusal dated Sep. 10, 2012, in Japanese Application No. 2008-330896.

* cited by examiner

*Primary Examiner* — Sophia S Chen
(74) *Attorney, Agent, or Firm* — Fitzpatrick, Cella, Harper & Scinto

(57) ABSTRACT

An image processing apparatus is provided in which the accuracy of measurement of an amount of toner adhesion is improved by forming a toner image pattern according to a detection scheme for the amount of toner adhesion. In the image processing apparatus, a toner image pattern control unit 215 determines a detection scheme for the amount of toner adhesion of a toner image based on attribute information of the toner image, decides a toner image pattern according to the results of that determination, and forms that decided toner image pattern. A toner adhesion amount calculation unit 605 measures the amount of toner adhesion for the toner image pattern formed by the toner image pattern control unit 215.

12 Claims, 8 Drawing Sheets

MEASUREMENT OF AMOUNT OF TONER ADHESION ON TRANSFER BELT

MEASUREMENT OF AMOUNT OF TONER ADHESION ON PHOTOSENSITIVE DRUM

IMAGE PROCESSING APPARATUS AND IMAGE PROCESSING APPARATUS CONTROL METHOD

BACKGROUND OF THE INVENTION

1. Field of the Invention

The present invention relates to an image processing apparatus and a method for controlling the image processing apparatus, and more specifically relates to technology for measuring an amount of toner adhesion for a toner image that has been formed on an image carrier.

2. Description of the Related Art

The color of an image formed by an electrophotographic image processing apparatus varies due to a change in various physical parameters, even if the settings of the apparatus when forming an image are fixed. In particular, developing and transfer processes contribute in a high proportion to such color variation. When the position of a latent image, amount of toner supplied, transfer efficiency, and so forth change due to environmental variations in temperature, humidity, and so forth, the amount of adhesion of toner that adheres to a photosensitive drum or a transfer belt is not stable. Therefore, it is necessary to stabilize the developing and transfer processes by measuring the amount of toner adhesion on the photosensitive drum or on the transfer belt, and performing feedback control of an exposure amount, developing voltage, transfer current, and so forth based on the results of that measurement.

Ordinarily, such control is performed when variation in the printer environment occurs, such as after exchanging toner cartridges, after printing a predetermined number of pages, or after turning on power to the main body of the printer. When measuring the amount of toner adhesion, the image processing apparatus forms a plurality of toner patches of various densities from low density to high density on the photosensitive drum or on the transfer belt. Furthermore, the amount of toner adhesion of these toner patches is measured with a toner adhesion amount measuring apparatus, and various controls are performed with appropriate image forming conditions based on the results of that measurement.

Here, technology for measuring the amount of toner adhesion is disclosed in Japanese Patent Laid-Open Nos. 62-280869, 3-209281, and 8-327331. Japanese Patent Laid-Open Nos. 62-280869 and 3-209281 disclose a method in which the amount of reflected light when light is irradiated on an image carrier, and the amount of reflected light when light is irradiated on a toner patch, are detected, the amount of toner adhesion is measured from the change in these amounts of reflected light, and image density parameters are controlled based on this measured value.

Also, Japanese Patent Laid-Open No. 8-327331 discloses a method for detecting the amount of toner adhesion by measuring the thickness of a toner patch with a laser displacement gauge. In this method, spot light is irradiated on an image carrier to form an image of reflected light at a position corresponding to the thickness of a toner patch that adheres onto the image carrier, and the amount of toner adhesion is measured by detecting a change in the position of the formed image with a PSD (Position Sensing Device). Afterward, feedback control of image density parameters of the capture system is performed based on the results of that measurement.

However, in the schemes for measuring the amount of toner adhesion based on the amount of reflected light that are described in Japanese Patent Laid-Open Nos. 62-280869 and 3-209281, there is the problem that the accuracy of measurement worsens in an area with higher density.

In the case of measuring the amount of toner adhesion from the reflection position described in Japanese Patent Laid-Open No. 8-327331, the physical shape of the toner patch is measured, so it is possible to measure the amount of adhesion regardless of the toner color. However, with this scheme, there is the problem that the accuracy of measurement worsens in an area with lower density.

SUMMARY OF THE INVENTION

In consideration of the above points, the present invention aims to form a toner image pattern according to the detection scheme of the amount of toner adhesion, and thus improve the accuracy of measurement of the amount of toner adhesion.

One aspect of the present invention provides an image processing apparatus, comprising: a determination unit adapted to determine a detection scheme of an amount of toner adhesion of a toner image based on attribute information of the toner image; a decision unit adapted to decide a pattern of the toner image according to the results of determination by the determination unit; a formation unit adapted to form the toner image with the pattern decided by the decision unit; and a measurement unit adapted to measure the amount of toner adhesion of the toner image by the determined detection scheme, for the toner image pattern formed by the formation unit.

Another aspect of the present invention provides a method for controlling an image processing apparatus, the method comprising: a determination step of determining a detection scheme of an amount of toner adhesion of a toner image based on attribute information of the toner image; a decision step of deciding a pattern of the toner image according to the results of determination in the determination step; a formation step of forming the toner image with the pattern decided in the decision step; and a measurement step of measuring the amount of toner adhesion of the toner image by the determined detection scheme, for the toner image pattern formed in the formation step.

Still another aspect of the present invention provides a computer-readable recording medium, on which is recorded a program for causing a computer to execute: a determination step of determining a detection scheme of an amount of toner adhesion of a toner image based on attribute information of the toner image; a decision step of deciding a pattern of the toner image according to the results of determination in the determination step; and a measurement step of measuring the amount of toner adhesion of the toner image by the determined detection scheme, for the toner image pattern formed by a formation unit in the pattern decided in the decision step.

Yet another aspect of the present invention provides an image processing apparatus, comprising: a formation unit adapted to form on an image carrier a plurality of first toner images having a density of at least a predetermined threshold value, and a second toner image having a size larger than the first toner images and a density of less than the predetermined threshold value; and a measurement unit adapted to measure an amount of toner adhesion for the first toner images and the second toner image.

Still yet another aspect of the present invention provides a method for controlling an image processing apparatus, the method comprising: a formation step of forming on an image carrier a plurality of first toner images having a density of at least a predetermined threshold value, and a second toner image having a size larger than the first toner images and a density of less than the predetermined threshold value; and a measurement step of measuring an amount of toner adhesion for the first toner images and the second toner image.

Yet still another aspect of the present invention provides a computer-readable recording medium, on which is recorded a program for causing a computer to execute a measurement step of measuring the amount of toner adhesion of a plurality of first toner images having a density of at least a predetermined threshold value that are formed on an image carrier by a formation unit, and of a second toner image having a size larger than the first toner images and a density of less than the predetermined threshold value, and that is formed on the image carrier by the formation unit.

According to the present invention, it is possible to form a toner image pattern according to the detection scheme of the amount of toner adhesion, and thus possible to improve the accuracy of measurement of the amount of toner adhesion.

Further features of the present invention will become apparent from the following description of exemplary embodiments (with reference to the attached drawings).

DESCRIPTION OF THE EMBODIMENTS

Following is a detailed description of embodiments of the present invention, with reference to the attached drawings.

Figure 1:
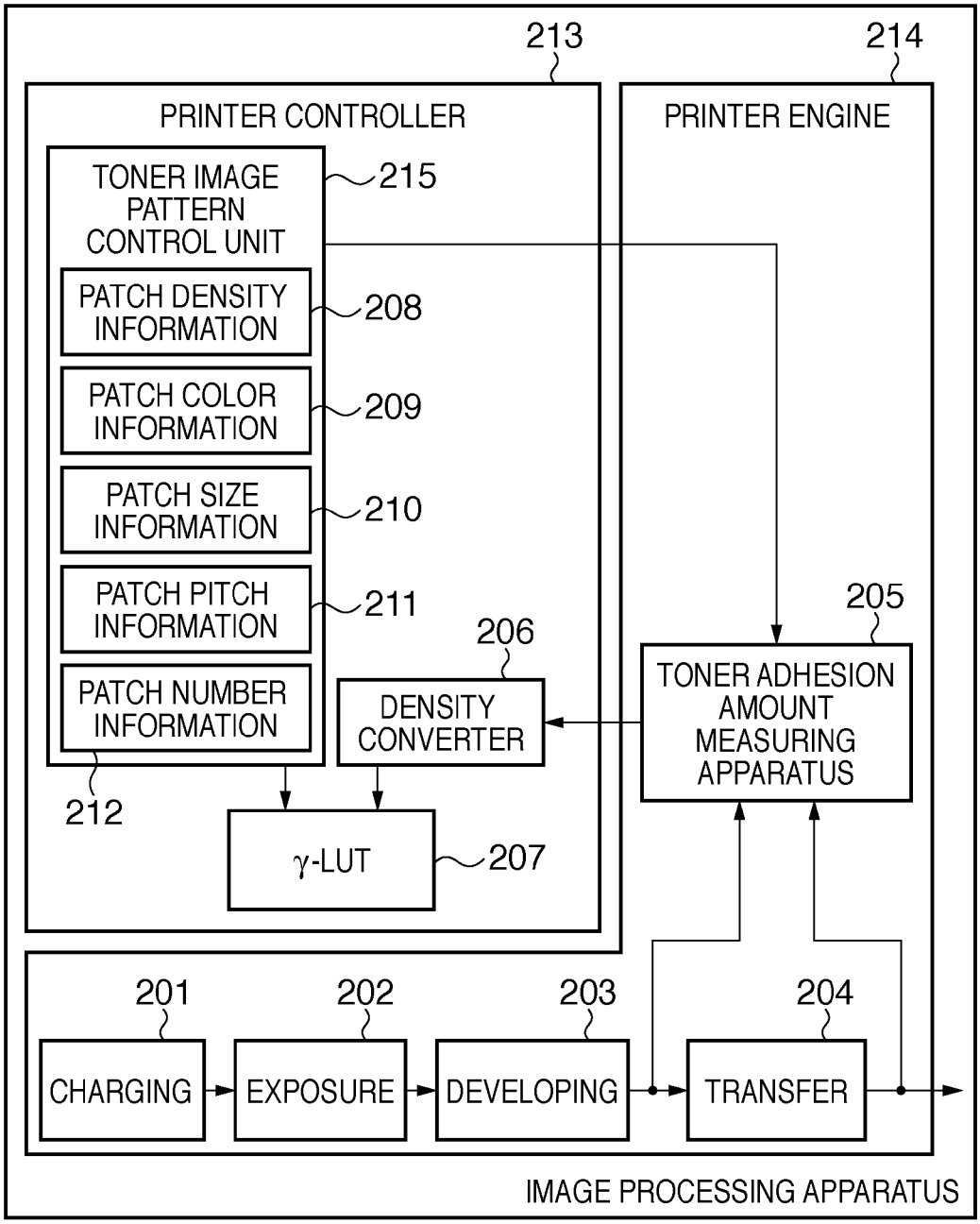
FIG. 1 shows the configuration of an electrophotographic image processing apparatus according to an embodiment of the present invention.

FIG. 1 shows the configuration of an electrophotographic image processing apparatus according to an embodiment of the present invention. As shown in FIG. 1, this image processing apparatus is configured from a printer controller 213 and a printer engine 214. The printer controller 213 is configured from a toner image pattern control unit 215, a density converter 206 that converts an amount of toner adhesion to a density, and a γ-LUT 207. The printer engine 214 is provided with a charging process 201, an exposure process 202, a developing process 203, and a transfer process 204 as functional configurations of the printer engine 214, and a toner adhesion amount measuring apparatus 205 as a hardware configuration of the printer engine 214. The printer controller 213 and the printer engine 214 also have various other functional configurations, but here only configurations that are distinguishing features are described.

Figure 2A:
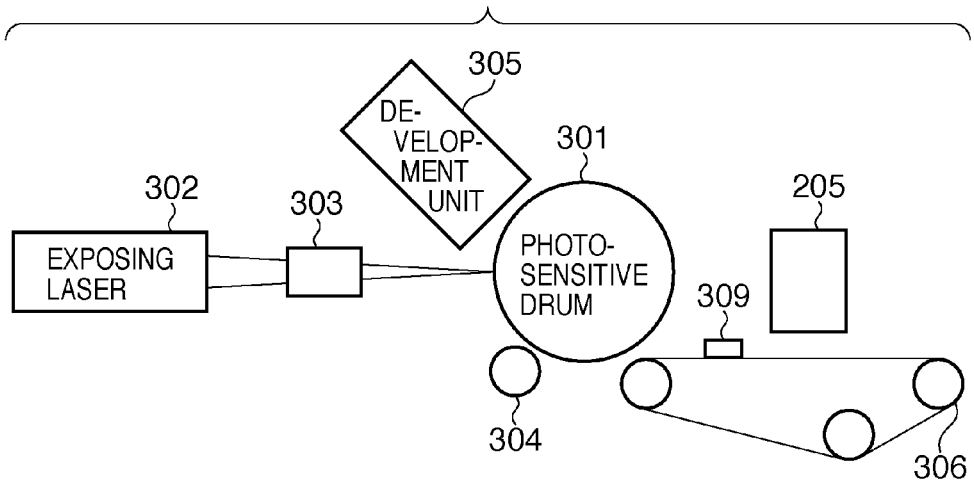
FIGS. 2A and 2B show the hardware configuration of a printer engine applied in an embodiment of the present invention.
Figure 2B:
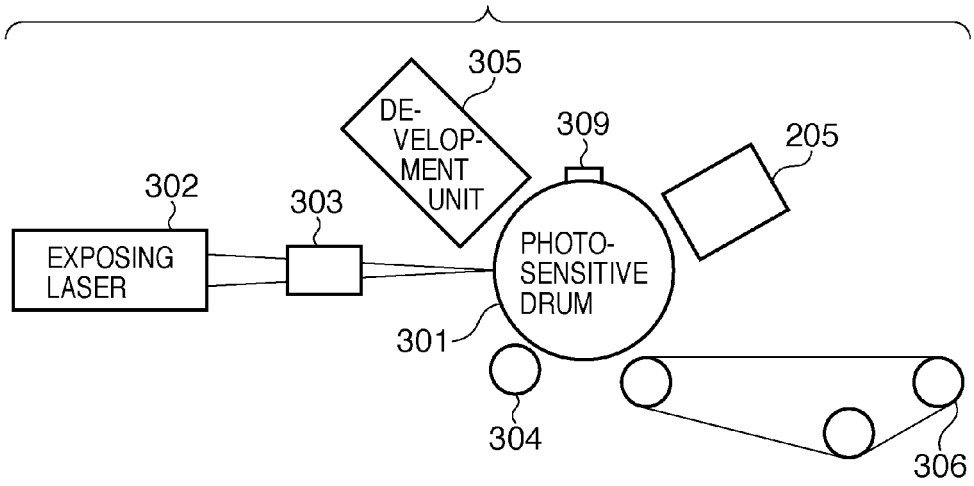

FIGS. 2A and 2B show the hardware configuration of the printer engine 214 applied in the present embodiment. As shown in FIGS. 2A and 2B, the printer engine 214 is provided with a photosensitive drum 301 serving as an image carrier, an exposing laser 302, a polygon mirror 303, a charging roller 304, a development unit 305, a transfer belt 306, and the toner adhesion amount measuring apparatus 205.

Following is a description of processing of the image processing apparatus according to the present embodiment with reference to FIGS. 1, 2A, and 2B. First, processing of the image processing apparatus will be described with reference to FIG. 1. A toner image pattern control unit 215 decides an optimal toner image pattern (patch size information 210, patch pitch (patch interval) information 211, and patch number information 212) based on patch density information 208 and patch color information 209 of a desired toner patch (toner color). Details of the method for deciding the toner image pattern will be described later with reference to a flowchart in FIG. 7. Next, the toner image pattern control unit 215 corrects the decided toner image pattern with the γ-LUT 207, in which density γ properties data has been stored.

Next, processing of the image processing apparatus will be described with reference to FIG. 2A. The printer engine 214 forms the corrected toner image pattern on the photosensitive drum 301 as an electrostatic latent image. That is, the printer engine 214, after charging the photosensitive drum 301 with the charging roller 304 (charging process 201), irradiates laser light from the exposing laser 302 onto the photosensitive drum 301 using the polygon mirror 303, thus forming an electrostatic latent image on the photosensitive drum 301 (exposure process 202).

When the electrostatic latent image is thus formed on the photosensitive drum 301, the printer engine 214 uses the developing unit 305 to develop that electrostatic latent image on the photosensitive drum 301 as a toner patch 309 (developing process 203). Next, the printer engine 214 transfers the toner patch 309 from the photosensitive drum 301 to the transfer belt 306 (transfer process 204). Further, the printer engine 214 uses the toner adhesion amount measuring apparatus 205 to measure the amount of toner adhesion of the toner patch 309 on the transfer belt 306.

Note that, as shown in FIG. 2B, measurement of the amount of toner adhesion may also be performed on the photosensitive drum 301 immediately after development of the toner patch 309 by the developing process 203.

Next, as shown in FIG. 1, the toner adhesion amount measuring apparatus 205 feeds back measured amount of toner adhesion data to the printer controller 213. The measured amount of toner adhesion data that is fed back is converted to a density value by the density converter 206. The printer controller 213 compares the density data (set value) of the developed toner patch 309 to toner density data (actually measured value) actually measured by the toner adhesion amount measuring apparatus 205, and corrects the density γ properties stored in the γ-LUT 207 based on these pieces of data.

As described above, in the image processing apparatus according to the present embodiment, the optimal toner image pattern decided by the toner image pattern control unit 215 is measured by the toner adhesion amount measuring apparatus 205. Furthermore, in the image processing apparatus, by feeding back the amount of toner adhesion obtained from that measurement to the printer controller 213, color variation in the image processing apparatus is suppressed.

Figure 3:
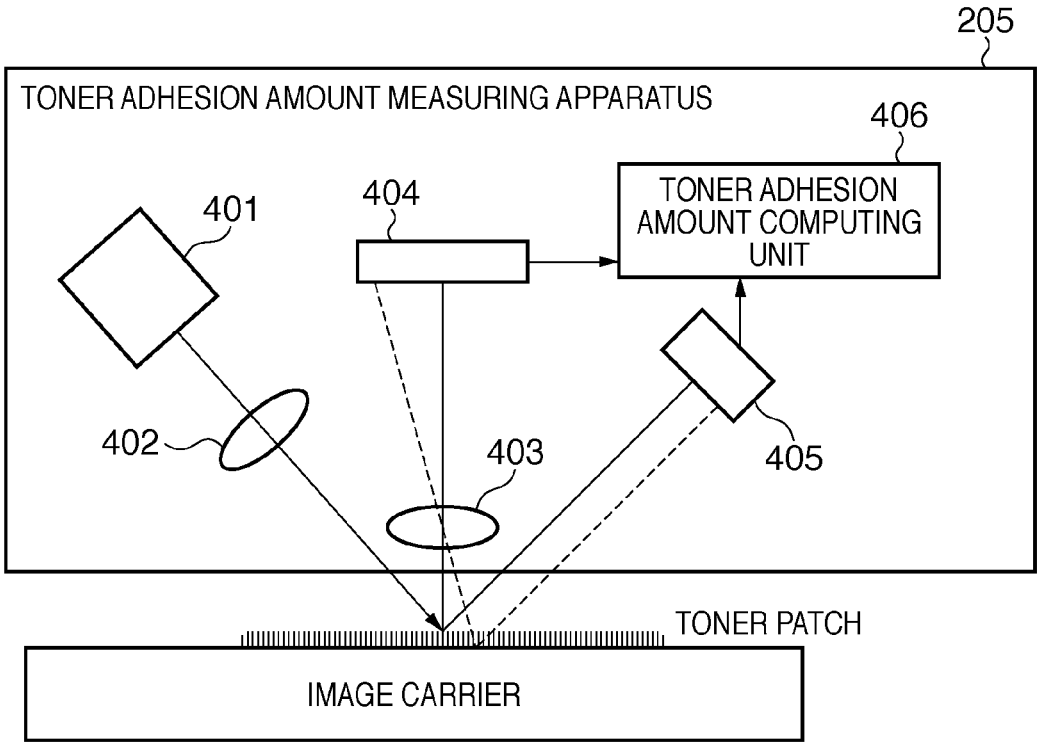
FIG. 3 shows the configuration of a toner adhesion amount measuring apparatus in an embodiment of the present invention.

FIG. 3 shows the configuration of the toner adhesion amount measuring apparatus 205 according to the present embodiment. The toner adhesion amount measuring apparatus 205 is provided with a laser light source 401, a condenser lens 402, a receiving lens 403, a CMOS line sensor 404, a photodiode 405, and a toner adhesion amount computing unit 406.

The laser light source 401 irradiates laser light onto an image carrier (the transfer belt 306 or the photosensitive drum 301) and a toner patch. The condenser lens 402 condenses laser light into a small spot shape. The receiving lens 403 forms an image of reflected light from the toner patch on a capture element according to the thickness of the toner patch. The CMOS line sensor 404 captures a diffuse reflection waveform of light formed into an image by the receiving lens 403. The photodiode 405 measures only an amount of light that has been specularly reflected from the toner patch (amount of specular reflected light). The toner adhesion amount computing unit 406 calculates the amount of toner adhesion from the obtained diffuse reflection waveform data and amount of specular reflected light data. In the present embodiment, the receiving lens 403 and the CMOS line sensor 404 are disposed at a position in a solid angle where only diffuse reflected light is received, and the reflection position and amount of reflected light for diffuse reflected light are detected simultaneously by the CMOS line sensor 404. Also, the amount of specular reflected light is detected by the photodiode 405, which is placed at a specular reflection position.

Figure 4:
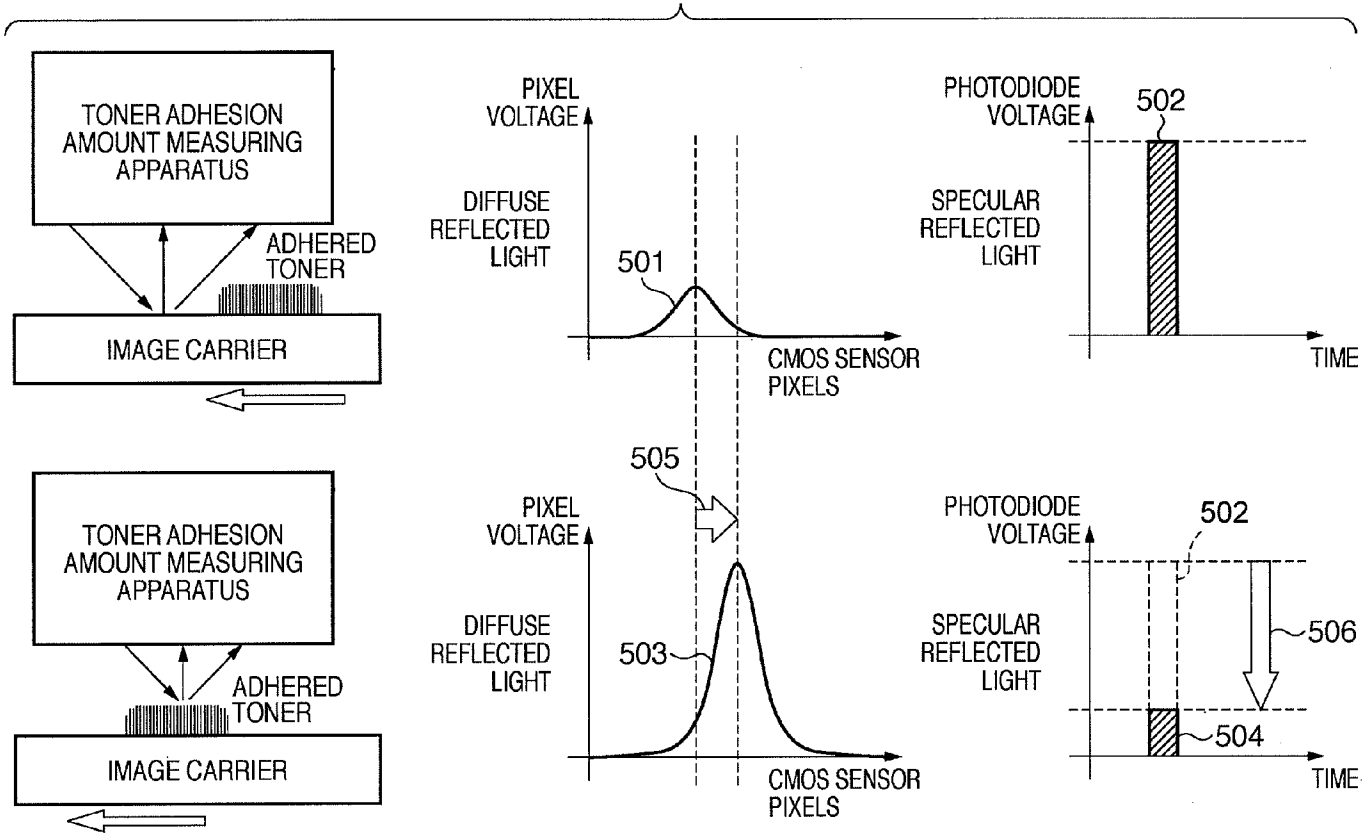
FIG. 4 illustrates measurement signals of reflected light from a toner patch and an image carrier.

FIG. 4 illustrates measurement signals of reflected light from the toner patch and the image carrier. When measuring the amount of toner adhesion, first, the laser light source 401 irradiates laser light on a portion of the surface of the image carrier where the toner patch is not formed. Thus, diffuse reflection waveform data 501 is detected from the CMOS line sensor 404, and amount of specular reflected light data 502 is detected from the photodiode 405.

Next, the laser irradiation position is moved to a portion of the surface of the image carrier where the toner patch is formed. Thus, diffuse reflection waveform data 503 from the toner patch is detected from the CMOS line sensor 404, and data 504 of the amount of specular reflected light from the toner patch is detected from the photodiode 405.

Computation of the amount of toner adhesion is performed by executing signal processing described later on the thus obtained diffuse reflection waveform data and amount of specular reflected light data obtained from the image carrier (reference) and the toner patch (changing portion), and calculating the amount of change of each of those pieces of data.

Figure 5:
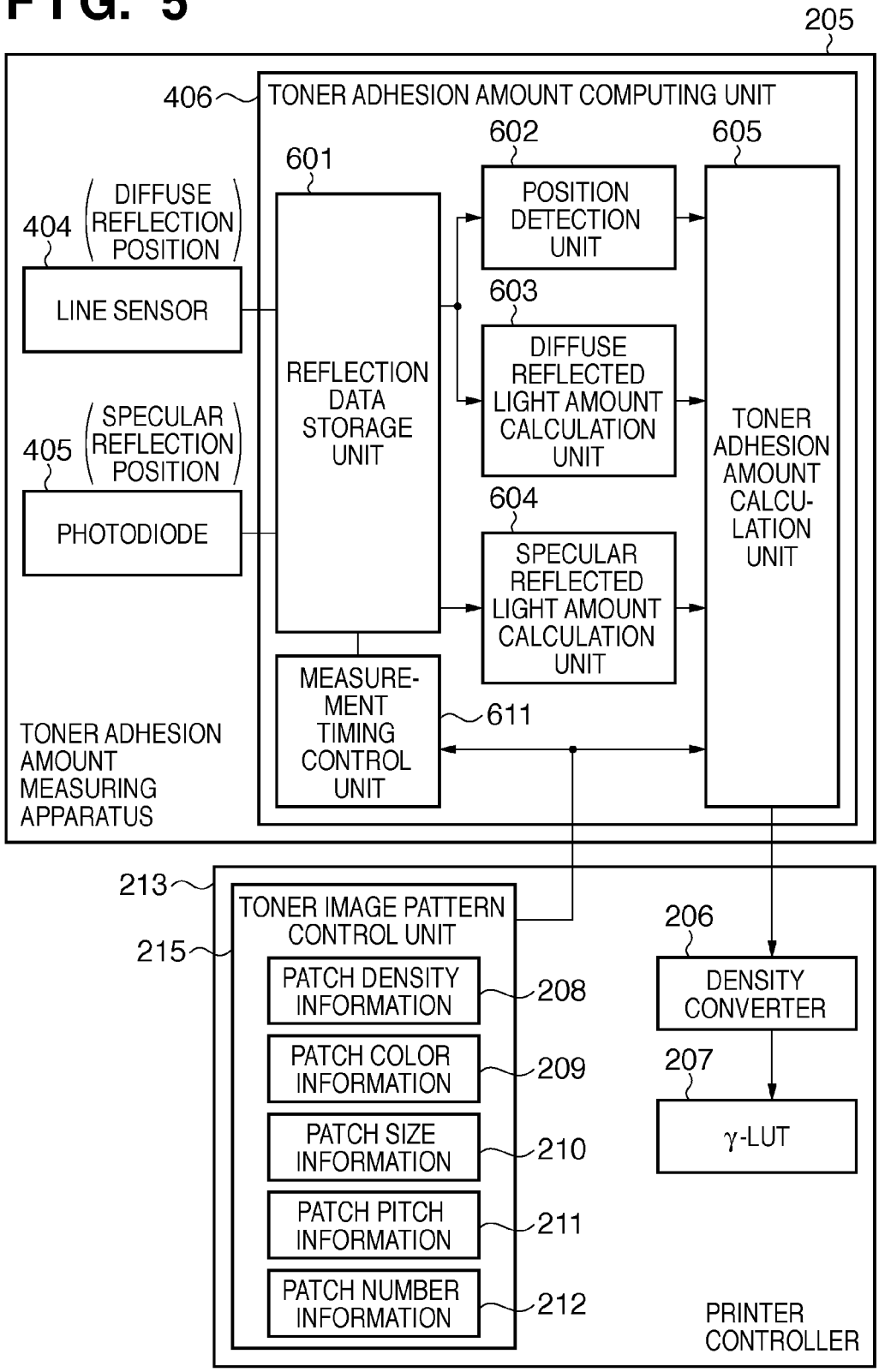
FIG. 5 is a block diagram that shows the functional configuration of a toner adhesion amount measuring apparatus 205 that calculates an amount of toner adhesion and a printer controller 213.

FIG. 5 is a block diagram that shows the functional configuration of the toner adhesion amount measuring apparatus 205 that calculates the amount of toner adhesion and the printer controller 213. A reflection data storage unit 601 stores the diffuse reflection waveform data obtained from the CMOS line sensor 404 and the amount of specular reflected light data obtained from the photodiode 405, in response to an instruction from a measurement timing control unit 611.

The measurement timing control unit 611 acquires the patch size information 210, the patch pitch information 211, and the patch number information 212 from the toner image pattern control unit 215 of the printer controller 213. Then, based on these pieces of information, the measurement timing control unit 611 calculates the timing at which the reflection data storage unit 601 will store the diffuse reflection waveform data and the amount of specular reflected light data, and also indicates that timing to the reflection data storage unit 601.

A position detection unit 602 calculates a reflection position by detecting the position of a peak that indicates the highest strength in the diffuse reflection waveform data stored in the reflection data storage unit 601, and detects a reflection position change amount 505 (see FIG. 4) between the image carrier and the toner patch.

A diffuse reflected light amount calculation unit 603 detects the change amount of the amount of diffuse reflected light between the image carrier and the toner patch by calculating the area of a peak portion in the diffuse reflection waveform data stored in the reflection data storage unit 601. On the other hand, a specular reflected light amount calculation unit 604 detects a change amount 506 (see FIG. 4) of the amount of specular reflected light between the image carrier and the toner patch stored in the reflection data storage unit 601.

In an example method for detecting a peak position from diffuse reflection waveform data, curve-fitting is performed by a least squares method employing a Gaussian function, and a predicting calculation is performed from parameters of the Gaussian function after this fitting. As shown in Formula 1, a Gaussian function has a bell-shaped peak centered on $x=\mu$, where $\mu$ indicates the peak position and A indicates the peak's height and increase/decrease in width.

$$f(x) = \frac{A}{\sqrt{2\pi\sigma^2}}\exp\left\{-\frac{(x-\mu)^2}{2\sigma^2}\right\} + C \qquad \text{Formula 1}$$

By fitting this formula to the diffuse reflection waveform data stored in the reflection data storage unit 601, it is possible to compute a characteristic amount that expresses the shape of the diffuse reflection waveform as the value of a parameter of the formula. The parameter $\mu$ obtained in this way can be used as the reflection position of light reflected from a test sample.

Fitting may also be performed using a formula other than a Gaussian function, i.e., using a Lorentzian function (Formula 2) or a second-order function (Formula 3). Also, only maximum value detection, without performing fitting, may be performed.

$$f(x) = \frac{2A}{\pi}\cdot\frac{w}{4(x-x_c)^2+w^2} + C \qquad \text{Formula 2}$$

$$f(x) = A(x-B)^2 + C \qquad \text{Formula 3}$$

In a scheme in which the amount of toner adhesion is detected based on the amount of reflected light, measurement accuracy decreases in an area with higher density. This is because the change in the amount of reflected light relative to the amount of applied toner is very small in an area with higher density, so an effective signal-to-noise ratio cannot be obtained.

On the other hand, in a scheme in which the amount of toner adhesion is detected based on the reflection position, in measurement of the amount of toner adhesion in an area with lower density where the toner patch is adhered thinly, the change in position of the peak point of the reflection waveform relative to the amount of applied toner is slight, so an adequate signal-to-noise ratio cannot be obtained. Accordingly, in this scheme measurement accuracy worsens in an area with lower density.

Also, when expressing image density levels in a digital image with halftones, dithering, or the like, the toner thickness is fixed, and that density is changed according to the ratio of the area of toner dots to be printed to the area of the image carrier. In the case of a toner image with a density changed in this manner, because thickness is fixed, the peak position is fixed for the toner reflection waveform and the image carrier reflection waveform. Thus, it is not possible to detect the amount of toner adhesion with high accuracy by only detecting the peak position. Accordingly, in an area with lower density, in which toner thickness is thin and an area coverage modulation effect is stronger, the accuracy of measurement from reflection position worsens. Consequently, in the present embodiment, the amount of toner adhesion in a low density portion is calculated using the amount of reflected light, and the amount of toner adhesion in a high density portion is calculated using the reflection position.

Also, in the image processing apparatus of the present embodiment, the surface of the transfer belt or the photosensitive drum has a high degree of flatness. Accordingly, when laser light is incident on that surface at 45°, almost all of the light is reflected in the specular reflection direction (i.e., there are many specular reflection components, and few diffuse reflection (scattered) components). Also, as black toner adheres to the transfer belt or the photosensitive drum, incident light is absorbed, so the amount of specular reflected light decreases. On the other hand, as color toner adheres, incident light is scattered (diffusely reflected) by the color toner, so the amount of diffuse reflected light increases. Consequently, in the present embodiment, the amount of toner adhesion of a black patch in a low density portion is calculated from the amount of reflected light of specular reflection components, and the amount of toner adhesion of a color patch in a low density portion is calculated from the amount of reflected light of diffuse reflection components.

The image processing apparatus according to the present embodiment realizes highly accurate measurement of the amount of toner adhesion of a toner patch by executing the processing described above.

Figure 6:
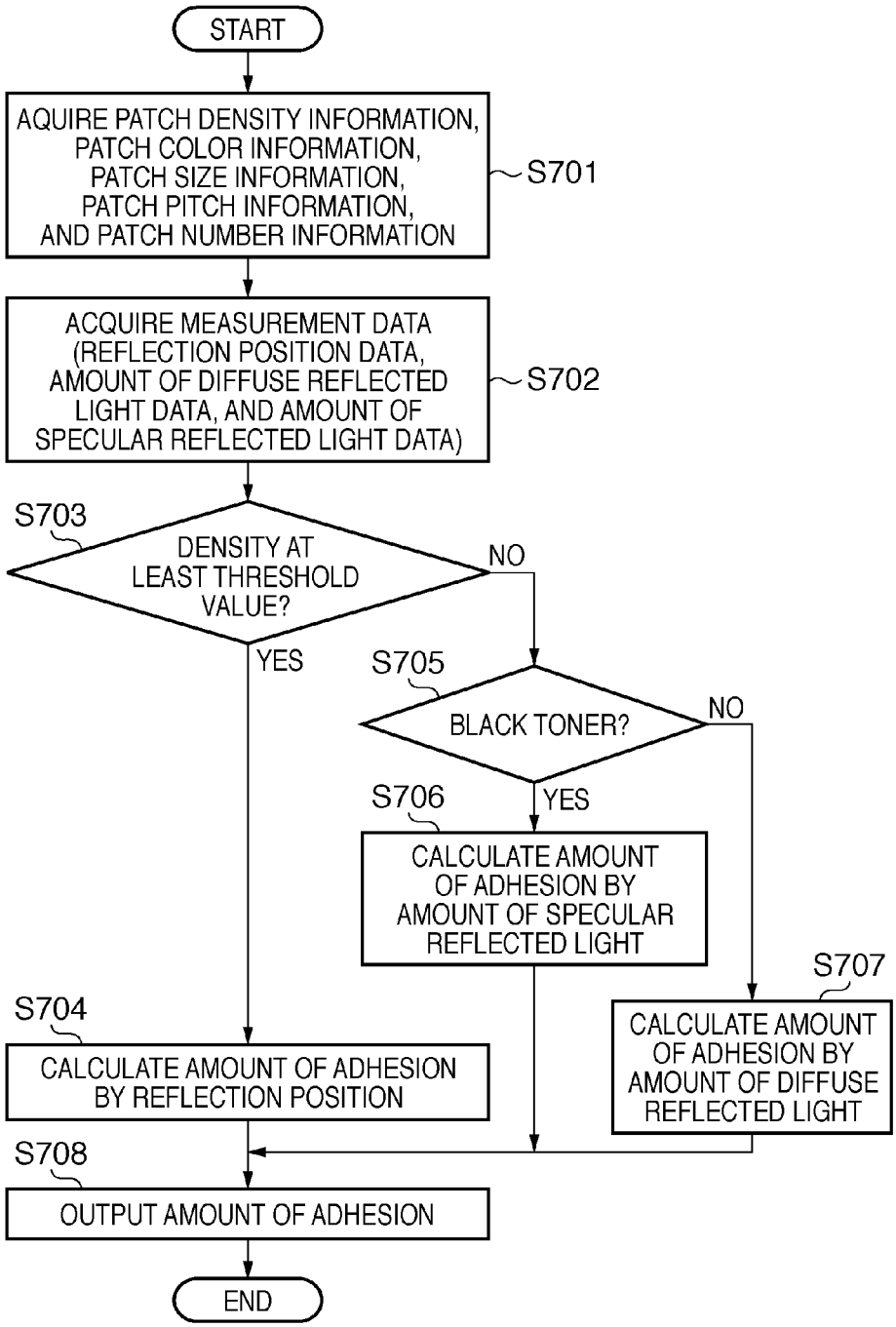
FIG. 6 is a flowchart that shows processing of a toner adhesion amount calculation unit.

FIG. 6 is a flowchart that shows processing of the toner adhesion amount calculation unit 605. Steps S701 to S708 indicate each step of processing. The toner adhesion amount calculation unit 605 acquires the patch density information 208, the patch color information 209, the patch size information 210, the patch pitch information 211, and the patch number information 212 from the toner image pattern control unit 215 of the printer controller 213 (Step S701).

Next, the toner adhesion amount calculation unit 605, based on a timing signal from the measurement timing control unit 611, acquires the reflection position data, the amount of diffuse reflected light data, and the amount of specular reflected light data respectively from the position detection unit 602, the diffuse reflected light amount calculation unit 603, and the specular reflected light amount detection unit 604 (Step S702).

Next, the toner adhesion amount calculation unit 605 determines whether or not the acquired patch density information is at least a predetermined threshold value, based on the patch density information 208 (Step S703). Here, when the patch density information 208 is at least the predetermined threshold value, the toner adhesion amount calculation unit 605 judges that this is an area with higher density, in which the accuracy of measurement of the amount of toner adhesion will be higher for a scheme employing reflection position detection, and uses the reflection position data to calculate the amount of toner adhesion (Step S704).

On the other hand, when the patch density information is less than the predetermined threshold value, the toner adhesion amount calculation unit 605 judges that this is an area with lower density, in which the accuracy of measurement of the amount of toner adhesion will be higher for a scheme employing detection of the amount of reflected light, and proceeds to Step S705 and onward, where light amount data is calculated.

In Step S705, the toner adhesion amount calculation unit 605 determines whether or not the acquired patch color information is black toner. Here, when the acquired patch color information is black toner, the toner adhesion amount calculation unit 605 judges that the accuracy of measurement of the amount of toner adhesion will be higher for a scheme employing detection of the amount of specular reflected light, and uses amount of specular reflected light data to calculate the amount of toner adhesion (Step S706).

On the other hand, when the patch color information is color toner, the toner adhesion amount calculation unit 605 judges that the accuracy of measurement of the amount of toner adhesion will be higher for a scheme employing detection of the amount of diffuse reflected light, and uses amount of diffuse reflected light data to calculate the amount of toner adhesion (Step S707).

As described above, the amount of toner adhesion is calculated by the toner adhesion amount calculation unit 605 based on reflection position data, amount of diffuse reflected light data and amount of specular reflected light data, and information acquired from the printer controller 213. The respective amounts of toner adhesion calculated in Steps S704, S706, and S707 are output to the printer controller 213 side (Step S708). Steps S704, S706, and S707 are examples of processing by a measurement unit.

Figure 7:
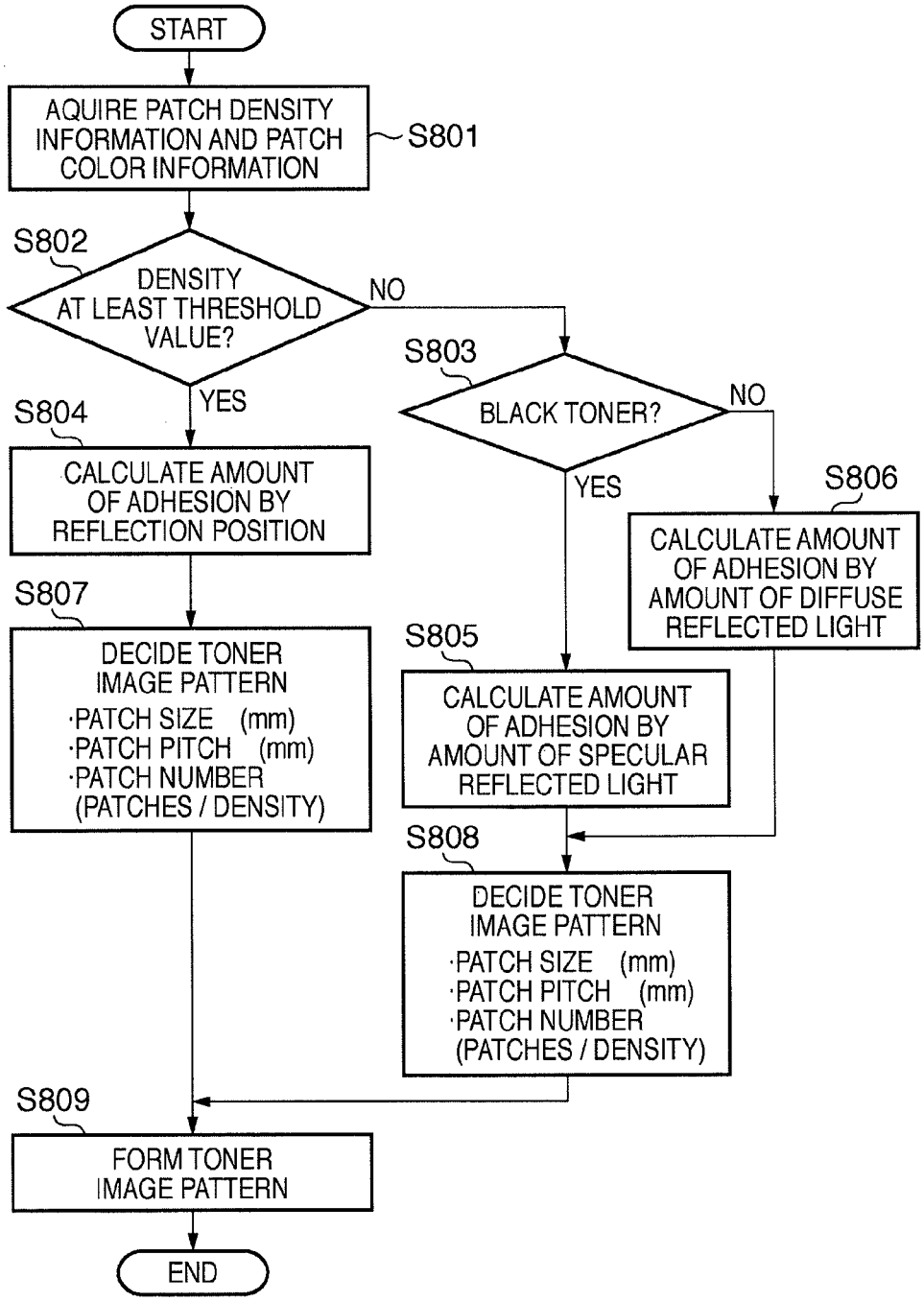
FIG. 7 is a flowchart that shows toner image pattern control processing in a toner image pattern control unit.

FIG. 7 is a flowchart that shows toner image pattern control processing in the toner image pattern control unit 215. Steps S801 to S808 indicate each step of processing. First, the toner image pattern control unit 215 acquires patch density information and patch color information of a desired toner patch (Step S801). The patch density information and patch color information is an example of application of attribute information.

Next, the toner image pattern control unit 215, based on toner density information, determines whether or not the density of that toner patch is at least a predetermined threshold value (Step S802). When that density is at least the predetermined threshold value, the toner image pattern control unit 215 judges that this is an area with higher density, in which the accuracy of measurement of the amount of toner adhesion will be higher for a scheme employing reflection position detection, and selects a scheme employing reflection position detection as the scheme for measuring the amount of toner adhesion (Step S804).

Figure 9:
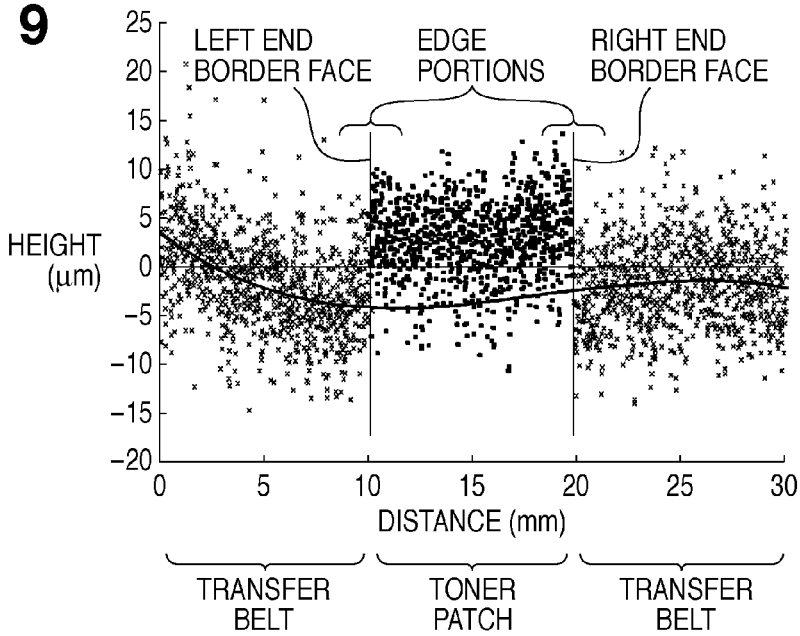
FIG. 9 shows results of actually measuring the height of a toner image with a reflection position detection scheme.

Next, the toner image pattern control unit 215 decides an optimal toner patch size, pitch, and number for reflection position detection (Step S807). Here, the scheme employing reflection position detection is likely to be influenced by undulations in the surface under the toner patch. FIG. 9 shows the results of actually measuring the height of the toner patch in the scheme employing reflection position detection. According to this scheme, as shown in FIG. 9, undulations, unevenness, and floppiness of the surface under the toner patch cannot be ignored relative to the height of the toner patch, so it is difficult to accurately calculate toner thickness. Consequently, it is conceivable that a scheme in which toner thickness is calculated from an edge portion of the toner patch will be effective. That is, by calculating height of the toner patch from an edge portion, it is possible to reduce the effects of such undulation.

According to this scheme employing edge detection, it is possible to reduce the size of the toner patch. On the other hand, because an edge portion can only be secured at two locations from one toner patch, effects of random noise are likely. Thus, a stable measurement value can be obtained by reducing the patch size and creating a plurality of the same toner patch. For such reasons, in the present embodiment, in the case of a scheme employing reflection position detection, the patch size is reduced and a plurality of the same patch are created. Note that it is necessary for the optimal value of the patch size, the pitch, and the patch number to be decided in advance through testing based on actual measurement.

Returning to FIG. 7, the toner image pattern control unit 215 forms the toner image pattern decided in Step S807 on the transfer belt 306 (Step S809).

On the other hand, in S802, when the density of the toner patch is less than the predetermined threshold value, the toner image pattern control unit 215 judges that this is an area with lower density, in which the accuracy of measurement of the amount of toner adhesion will be higher for a scheme employing detection of the amount of reflected light, and selects detection of the amount of light as the scheme for measuring the amount of toner adhesion and then proceeds to Step S803.

In Step S803, the toner image pattern control unit 215 determines whether or not the patch color of the desired toner patch is black toner. When the patch color is black toner, the toner image pattern control unit 215 judges that the accuracy of measurement of the amount of toner adhesion will be higher for a scheme employing detection of the amount of specular reflected light, and selects a scheme in which the amount of adhesion is calculated from the amount of specular reflected light (Step S805).

On the other hand, when the toner color of the desired toner patch is color toner, the toner image pattern control unit 215 judges that the accuracy of measurement of the amount of toner adhesion will be higher for a scheme employing detection of the amount of diffuse reflected light, and selects detection of the amount of diffuse reflected light (Step S806).

After Step S805 or S806, the toner image pattern control unit 215 decides an optimal toner patch size, patch pitch, and patch number for a scheme employing detection of the amount of reflected light (Step S808). In the present embodiment, the toner image pattern is the same for detection of the amount of diffuse reflected light and detection of the amount of specular reflected light, but optimal toner image patterns may also be individually decided.

A scheme employing detection of the amount of reflected light is unlikely to be influenced by undulations in the surface under the toner patch, so by adopting a larger patch size than in a scheme employing reflection position detection, it is possible to average out the measurement values in a long interval, and thus it is possible to obtain a stable measurement value with random noise removed. Accordingly, in the present embodiment, patch size and patch pitch are increased in the case of detection of the amount of reflected light.

Next, in Step S809, the toner image pattern control unit 215 forms the toner image pattern decided in Step S808 on the transfer belt 306. Note that Steps S802 to S806 are examples of processing by a determination unit, and Steps S807 and S808 are examples of processing by a deciding unit. Also, Step S809 is an example of processing by a formation unit.

Figure 8:
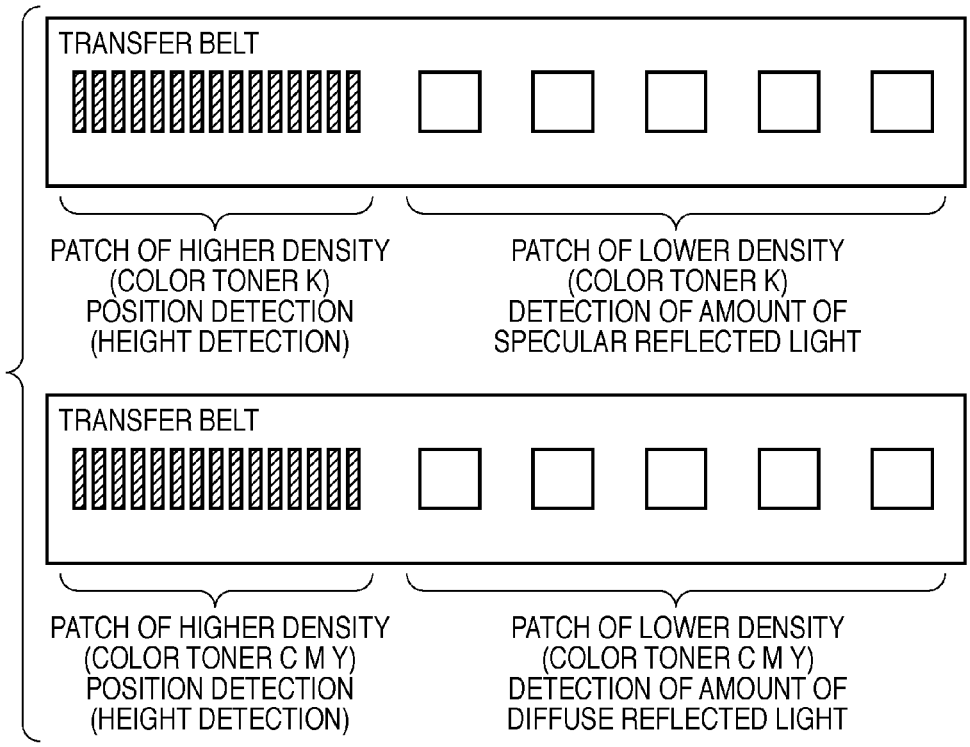
FIG. 8 shows an example of a toner image pattern created in an embodiment of the present invention.

The toner image pattern control unit 215 performs the above processing for toner patches of each density to form an optimal toner image pattern. FIG. 8 shows examples of toner image patterns created by this processing for color toner K (black) and color toners (C, M, and Y (cyan, magenta and yellow).

As described above, in a toner patch having density of at least a predetermined threshold value, in order to perform height detection, in particular measurement of height from a toner edge, the patch size of the toner patch is reduced, and a plurality of the same toner patch are formed. On the other hand, in a toner patch having density (low density) of less than the predetermined threshold value, the toner patch is made larger in order to perform measurement by detecting the amount of light. That is, in the present embodiment, by detecting the position of reflected light from a toner patch of higher density (a first toner image), for light that has been irradiated from the laser light source 401 (light irradiation unit), the amount of toner adhesion of that toner patch is measured. Also, by detecting the amount of reflected light from a toner patch of lower density (a second toner image), for light that has been irradiated from the laser light source 401, the amount of toner adhesion of that toner patch is measured.

As described above, the image processing apparatus according to the present embodiment forms an optimal toner image pattern according to a scheme for measuring the amount of toner adhesion based on detection of the amount of reflected light or detection of the reflection position. Thus, it is possible to improve the accuracy of measurement of the amount of toner. Also, by forming an optimal patch pattern, it is possible to decrease the amount of toner consumption. Also, shortening of the measurement time can be anticipated.

In the above embodiment, as shown in FIG. 7, the patch size, patch pitch, and patch number are calculated using density information and color information of the patch. However, results calculated in advance may be stored for those pieces of information. More specifically, a patch size, patch pitch, and patch number may be stored in advance, in association with the patch density and color.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-330896, filed Dec. 25, 2008, which is hereby incorporated by reference herein in its entirety.

What is claimed is:

1. An image processing apparatus, comprising:

a determination unit adapted to determine a detection scheme of an amount of toner adhesion of a toner image based on attribute information of the toner image;

a decision unit adapted to decide a pattern of the toner image according to the results of determination by the determination unit;

a formation unit adapted to form the toner image with the pattern decided by the decision unit; and a measurement unit adapted to measure the amount of toner adhesion of the toner image by the determined detection scheme, for the toner image pattern formed by the formation unit unit, wherein the determination unit is adapted to determine, based on the attribute information of the toner image, as a detection scheme of the amount of toner adhesion of the toner image, whether to detect the amount of toner adhesion from a reflection position of reflected light from the toner image, or to detect the amount of toner adhesion from the amount of reflected light reflected from the toner image.

2. The image processing apparatus according to claim 1, wherein the size of the toner image decided by the decision unit when the determination unit has determined to detect the amount of toner adhesion from the reflection position is smaller than a size of the toner image decided by the decision unit when the determination unit has determined to detect the amount of toner adhesion from the amount of reflected light.

3. The image processing apparatus according to claim 2, wherein the decision unit is adapted to decide to form a plurality of the same toner image when the determination unit has determined to detect the amount of toner adhesion from the reflection position.

4. The image processing apparatus according to claim 1, wherein the attribute information of the toner image includes at least any one of density information of the toner image and color information of the toner image.

5. A method for controlling an image processing apparatus, the method comprising:

a determination step of determining a detection scheme of an amount of toner adhesion of a toner image based on attribute information of the toner image;

a decision step of deciding a pattern of the toner image according to the results of determination in the determination step;

a formation step of forming the toner image with the pattern decided in the decision step; and a measurement step of measuring the amount of toner adhesion of the toner image by the determined detection scheme, for the toner image pattern formed in the formation step, wherein the determination step is adapted to determine, based on the attribute information of the toner image, as a detection scheme of the amount of toner adhesion of the toner image, whether to detect the amount of toner adhesion from a reflection position of reflected light from the toner image, or to detect the amount of toner adhesion from the amount of reflected light reflected from the toner image.

6. A computer-readable recording medium, on which is recorded a program for causing a computer to execute:

a determination step of determining a detection scheme of an amount of toner adhesion of a toner image based on attribute information of the toner image;

a decision step of deciding a pattern of the toner image according to the results of determination in the determination step; and a measurement step of measuring the amount of toner adhesion of the toner image by the determined detection scheme, for the toner image pattern formed by a formation unit in the pattern decided in the decision step, wherein the determination step is adapted to determine, based on the attribute information of the toner image, as a detection scheme of the amount of toner adhesion of the toner image, whether to detect the amount of toner adhesion from a reflection position of reflected light from the toner image, or to detect the amount of toner adhesion from the amount of reflected light reflected from the toner image.

7. An image processing apparatus, comprising:

a formation unit adapted to form on an image carrier a plurality of first toner images having a density of at least a predetermined threshold value, and a second toner image having a size larger than the first toner images and a density of less than the predetermined threshold value; and a measurement unit adapted to measure an amount of toner adhesion for the first toner images and the second toner image.

8. The image processing apparatus according to claim 7, wherein the plurality of first toner images each have the same shape.

9. The image processing apparatus according to claim 7, wherein a plurality of the second toner images are formed.

10. The image processing apparatus according to claim 7, wherein the measurement unit is adapted to measure the amount of toner adhesion of the first toner images by detecting a position of reflected light from the first toner images, for light irradiated from a light irradiation unit, and measures the amount of toner adhesion of the second toner image by detecting the amount of reflected light from the second toner image, for light irradiated from the light irradiation unit.

11. A method for controlling an image processing apparatus, the method comprising:

a formation step of forming on an image carrier a plurality of first toner images having a density of at least a predetermined threshold value, and a second toner image having a size larger than the first toner images and a density of less than the predetermined threshold value; and a measurement step of measuring an amount of toner adhesion for the first toner images and the second toner image.

12. A computer-readable recording medium, on which is recorded a program for causing a computer to execute a measurement step of measuring the amount of toner adhesion of a plurality of first toner images having a density of at least a predetermined threshold value that are formed on an image carrier by a formation unit, and of a second toner image having a size larger than the first toner images and a density of less than the predetermined threshold value, and that is formed on the image carrier by the formation unit.

* * * * *